US010424277B2

(12) United States Patent
Satterlee

(10) Patent No.: US 10,424,277 B2
(45) Date of Patent: Sep. 24, 2019

(54) ACCESSORY WEIGHTS AND KITS FOR A BRASS INSTRUMENT NECK

(71) Applicant: Eric Satterlee, Haslett, MI (US)

(72) Inventor: Eric Satterlee, Haslett, MI (US)

(73) Assignee: Eric Satterlee, Haslett, MI (US)

( * ) Notice: Subject to any disclaimer, the term of this patent is extended or adjusted under 35 U.S.C. 154(b) by 27 days.

(21) Appl. No.: 15/482,623

(22) Filed: Apr. 7, 2017

(65) Prior Publication Data

US 2017/0256243 A1 Sep. 7, 2017

Related U.S. Application Data

(63) Continuation-in-part of application No. 15/446,205, filed on Mar. 1, 2017, now Pat. No. 10,013,958.

(60) Provisional application No. 62/302,915, filed on Mar. 3, 216.

(51) Int. Cl.
*G10D 9/00* (2006.01)
*G10D 7/08* (2006.01)

(52) U.S. Cl.
CPC ..... *G10D 9/00* (2013.01); *G10D 7/08* (2013.01)

(58) Field of Classification Search
CPC ..... G10D 7/08; G10D 9/00
See application file for complete search history.

(56) References Cited

U.S. PATENT DOCUMENTS 5,847,300 A * 12/1998 Hackl ..... G10D 9/026 84/398
9,418,634 B1 * 8/2016 Brebner ..... G10D 9/00
2012/0152086 A1 * 6/2012 Slater ..... G10D 9/005 84/454

* cited by examiner

*Primary Examiner* — Kimberly R Lockett
(74) *Attorney, Agent, or Firm* — Fitch, Even, Tabin & Flannery, LLP

(57) ABSTRACT

Accessory weights and kits for brass instruments to reduce sympathetic vibration of a brass instrument having an instrument neck directed towards the instrument at a first end and connected to a mouthpiece at a second end; wherein the connection of the mouthpiece to the neck second end can be by a friction fit of a cork sleeve having a collar fixed to an outer surface of the neck second end; and a weight connected to the neck second end also by a friction fit to cork sleeve, wherein sympathetic vibration of a brass instrument is reduced while in use by between 10 and 50 percent.

18 Claims, 4 Drawing Sheets

ACCESSORY WEIGHTS AND KITS FOR A BRASS INSTRUMENT NECK

CROSS REFERENCE TO RELATED APPLICATION

This application is a Continuation-in-Part Application based on, and claims priority from, U.S. patent application Ser. No. 15/446,205, filed on Mar. 1, 2017, which claims priority from U.S. Provisional Patent Application No. 62/302,915, filed Mar. 3, 2016, the contents of which are hereby incorporated by reference in their entirety.

FIELD

Accessory weights and kits for brass instruments are described herein and, in particular, accessory weights and kits for brass instruments configured for attachment to a brass instrument neck.

BACKGROUND

A musical instrument is a device created or adapted to make musical sounds. The principal types of such instruments are typically classified by the method of producing sound, and can include percussion, stringed, keyboard, wind, and electronic instruments. A saxophone, for example, is a wind instrument and is usually made of brass and played with a single-reed mouthpiece. Brass instruments produce sound by sympathetic vibration of air in a tubular resonator in sympathy with the vibration of the player's lips.

In the art, accessories have been developed to modify, enhance, change and/or dampen the sound of an instrument. Such accessories provide added expression, amplitude and/or quality of sound. For brass instruments, this may include various mouthpiece shapes, muting devices and the like.

Despite development of such accessories, further devices and assemblies are desired to add further tonal variation and even improvement of the sound of a brass woodwind instrument.

SUMMARY

Accordingly, exemplary accessory weights and kits for brass instruments are provided herein and, in particular accessory weights and kits for brass instruments configured for attachment to a neck of a brass instrument.

In one embodiment, a weight assembly to reduce sympathetic vibration of a brass instrument is provided having an instrument neck directed towards the instrument at a first end and connected to a mouthpiece at a second end; wherein the connection of the mouthpiece to the neck second end can be by a friction fit of a cork sleeve having a collar fixed to an outer surface of the neck second end; and a weight connected to the neck second end also by a friction fit to cork sleeve, wherein sympathetic vibration of a brass instrument is reduced while in use by between 10 and 50 percent.

According to one approach, the weight assembly has a weight sufficient to reduce sympathetic vibration of the instrument during use. According to one approach, the weight assembly has a weight in the range of 30 grams to 100 grams. According to one approach, the weight assembly has a weight in the range of 50 grams to 70 grams. According to one approach, a body of the weight can be configured to extend from a mount on the cork sleeve towards the mouthpiece. According to one approach, a body of the weight can be configured to extend from a mount on the cork sleeve to be adjacent to the mouthpiece. According to one approach, a body of the weight can be configured to extend from a mount on the cork sleeve towards the mouthpiece, wherein in an installed position there is a gap between the mouthpiece and the weight. According to one approach, the gap can be configured to be between 2 mm and 10 mm. According to one approach, the gap can be configured to be between 3 mm to 7 mm. According to one approach, a body of the weight can be configured to extend from a mount on the cork sleeve towards the direction of the neck.

In another embodiment, a brass instrument is provided having an instrument neck directed towards the instrument at a first end and connected to a mouthpiece at a second end; wherein the connection of the mouthpiece to the neck second end is by a friction fit of a cork sleeve having a collar fixed to an outer surface of the neck second end; and a weight connected to the neck second end also by a friction fit to cork sleeve, wherein sympathetic vibration of a brass instrument is reduced while in use by between 10 and 50 percent.

According to one approach of this embodiment, the weight can have a weight sufficient to reduce sympathetic vibration of the instrument during use. According to one approach, the weight has a weight in the range of 30 grams to 100 grams. According to one approach, the weight has a weight in the range of 50 grams to 70 grams. According to one approach, a body of the weight can be configured to extend from a mount on the cork sleeve towards the mouthpiece. According to one approach, a body of the weight can be configured to extend from a mount on the cork sleeve to be adjacent to the mouthpiece. According to one approach, a body of the weight can be configured to extend from a mount on the cork sleeve towards the mouthpiece, wherein in an installed position there is a gap between the mouthpiece and the weight. According to one approach, a body of the weight can be configured to extend from a mount on the cork sleeve towards the direction of the neck.

In another embodiment, a mouthpiece for a brass instrument is provided having a shank having a bore for attachment to an instrument neck; wherein the attachment of the mouthpiece to the neck second end is by a friction fit from a cork sleeve having a collar fixed to an outer surface of the instrument neck; and the mouthpiece weighted to reduce sympathetic vibration of a brass instrument is reduced while in use by between 10 and 50 percent.

The weight assembly in one approach can have a removable cover layer over the weight. Indicia can be added on an outer surface of the weight.

ELEMENT NUMBERS

Figure 10:
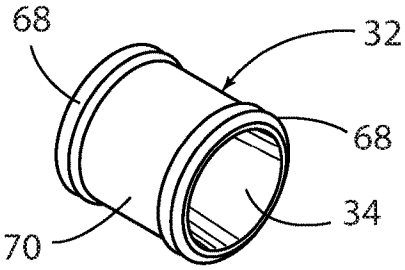
FIG. 10 illustrates a left perspective view of the weight accessory (32) for a brass instrument neck according to one approach.

20 exemplary instrument (horn)(brass)
22 neck of an exemplary saxophone
24 mouthpiece
26 octave key
28 neck cork
30 neck cork collar
32 exemplary weight
34 exemplary weight bore
36 shank
38 dimension of outer diameter of the shank (36)
40 dimension of bore to clear the shank (36 in Fig.) or alternately the neck
42 narrowed neck region for cork attachment
44 dimension of outer diameter of the neck cork (28)
46 dimension of bore to engage cork (28)
48 bore to engage cork (28)
50 beak
52 barrel
54 table (for reed placement)
56 tip
58 bore
60 length of bore 48 (gripped portion)
62 dimension of portion of length of weight 32 (non-gripped portion)
64 outer diameter of weight 32
66 overall length of weight 32
68 rings
70 outer surface of weight 32 (FIG. 10)
72 bore 34 dimension distal to bore 48
74 bore 34 dimension proximal to bore 48
76 distal neck portion
78 step dimension
80 mouthpiece bore
82 dimension of outer diameter of the neck cork collar (30)
84 downwind direction

DETAILED DESCRIPTION

Brass woodwind instruments and accessory weights and kits for such instruments are described herein. In particular, instruments and accessory weights and kits for brass instruments are provided and configured for attachment to a neck and/or mouthpiece of a brass instrument. The added mass of the weight is preferably located on or attached to the neck of the instrument where a mouthpiece attaches to the neck. As shown according to one approach, this added mass can be a weight that pressure fitted to a cork sleeve on the instrument neck prior to mouthpiece pressure fitted to the cork sleeve, or built into the instrument or attached onto the mouth piece.

The described instruments with added mass reduce sympathetic vibration while in use by between 10 and 50 percent. This provides more tonal flexibility to a user of a brass woodwind instruments. Additionally, the presented embodiments can also adjust the quality of the musical sound from the instrument. A tangible difference in low register response, and a generally darker timbre from the horn as well may be expected. Instrument articulation can be easier instantly, as well as slurring to low register notes over large intervals.

In the present embodiments, the illustrated weight, or ones with a different shapes and/or size can be utilized on any modern saxophone, preferably one having a cork sleeve on the neck piece to hold the mouth piece. Optionally, a magnetized "doughnut" weight can be split into halves and wrapped around the neckpiece and held onto the instrument by the magnetic force of the two halves to each other. Optionally, the weigh can have a snap on bracket to hold it to the neckpiece without vibration.

In a magnetized split doughnut embodiment, one or both of the weight halves can be a permanent magnet, which means it is made from a material that is magnetized and creates its own persistent magnetic field. The opposing half can also be magnetized or at least made from a material that strongly attract a magnet. Materials that can be magnetized, which are also the ones that are strongly attracted to a magnet, are called ferromagnetic (or ferromagnetic). These include iron, nickel, cobalt, some alloys of rare earth metals, and some naturally occurring minerals such as lodestone.

Figure 1:
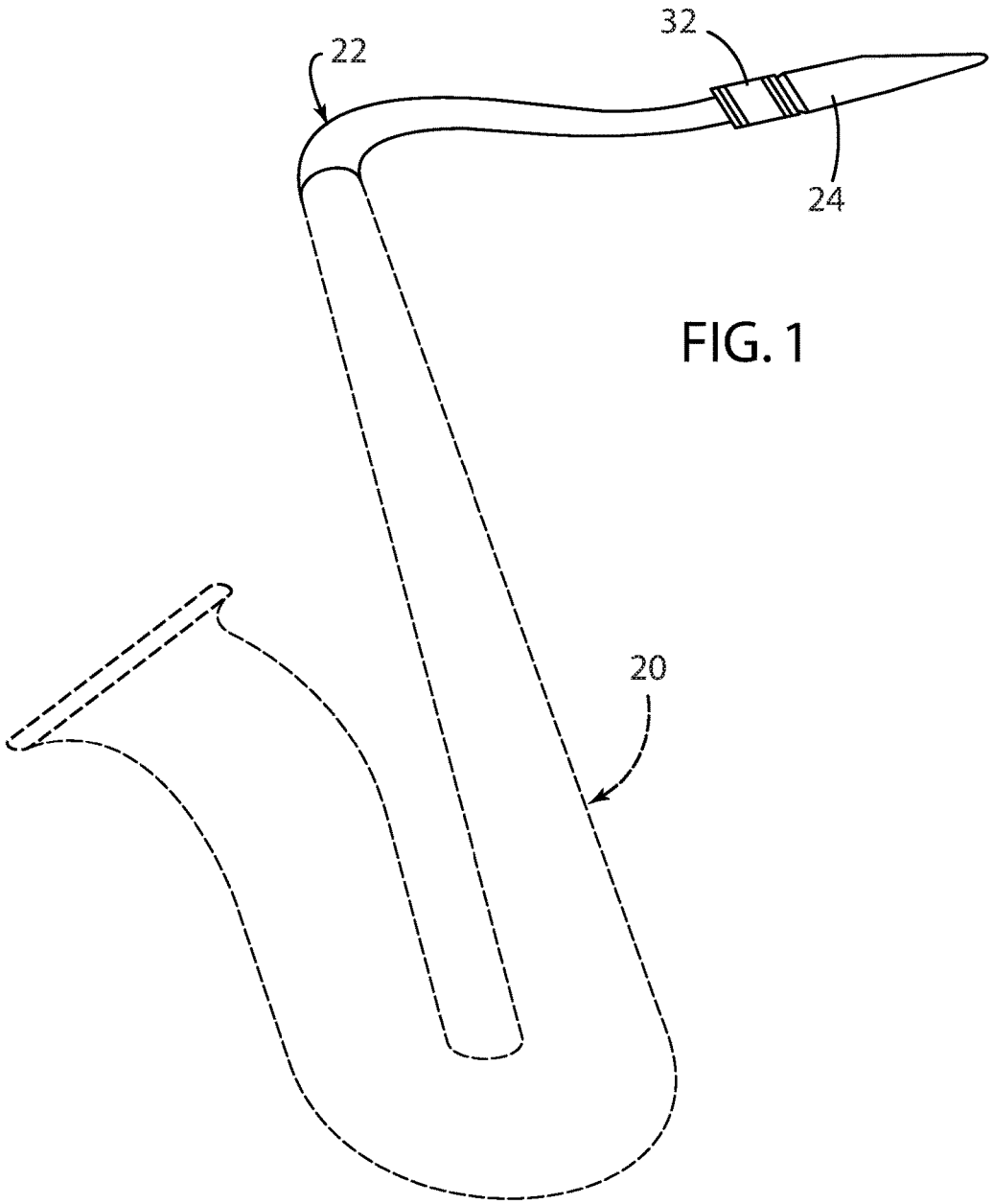
FIG. 1 illustrates a side view of an exemplary embodiment of a weight accessory for a brass instrument on a saxophone neck.

FIG. 1 shows an exemplary woodwind instrument or brass horn such as a saxophone generally indicated at 20, having a neckpiece 22 and a mouthpiece 24. An exemplary embodiment of a present weight assembly ("weight") 32 to dampen sympathetic vibrations is disposed between neckpiece 22 and mouthpiece 24. It is noted that the specific cylindrical profile embodiment for weight 32 is provided for illustrative purposes. Other shapes, profiles, cones, squares, ribbed, inscribed indicia, curves, and the like can vary widely so long as the desired weight and contact with the neck and/or mouthpiece are achieved. It is also noted that while the described embodiments are configured to pressure fit onto an instrument neck at the cork sleeve, other attachment means are possible and can even be integral and incorporated during manufacture of the instrument neck and/or mouthpiece. As shown, weight 32 of the assembly can be about 30 grams to about 100 (and preferably about 50 grams to 70 grams).

Figures 2, 3, 4:
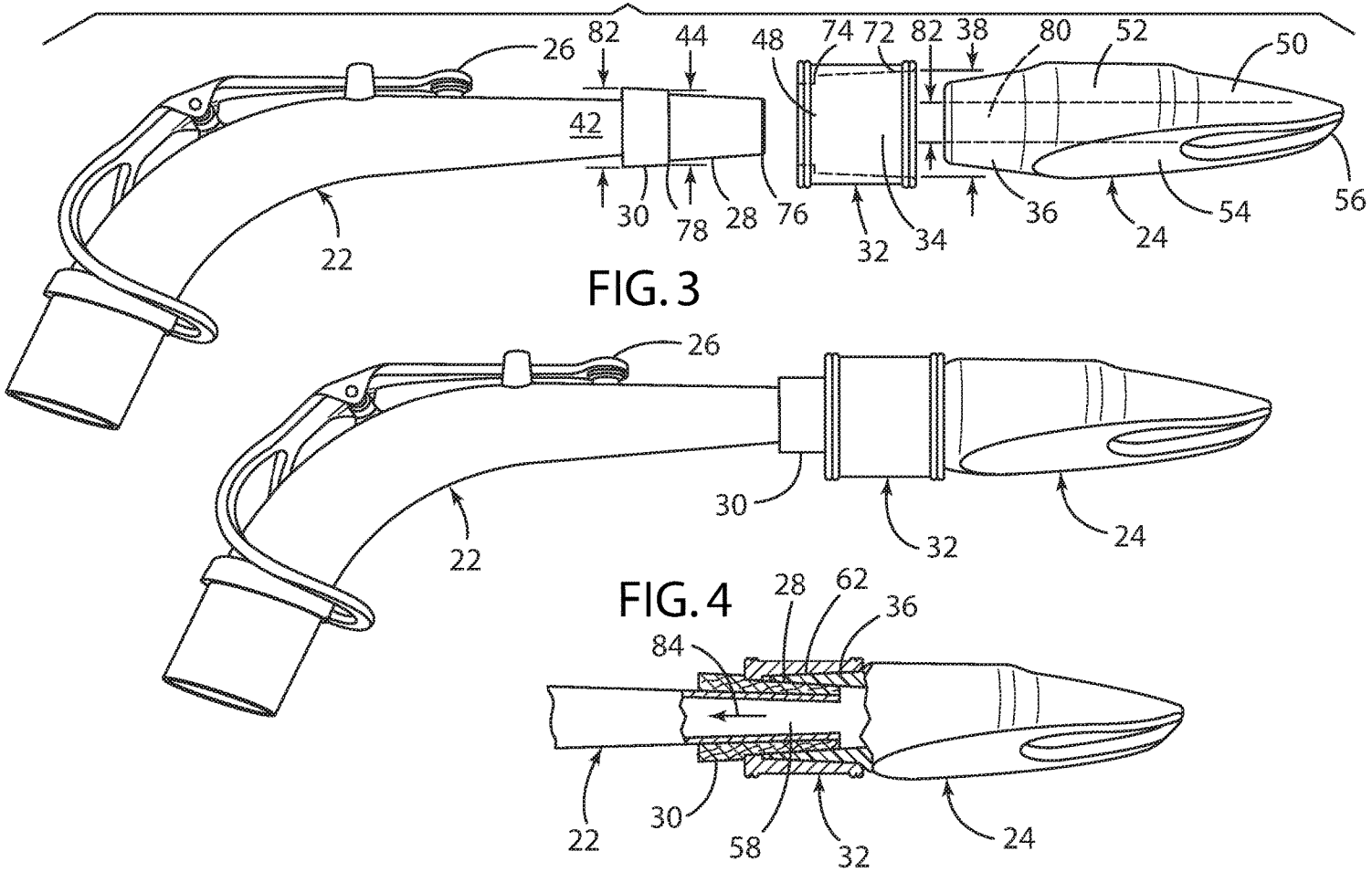
FIG. 2 illustrates an exploded side view of the weight accessory of FIG. 1.
FIG. 3 illustrates a side view of an assembled weight accessory of FIG. 1.
FIG. 4 illustrates a cutaway view of the assembled weight accessory of FIG. 3.
Figure 5:
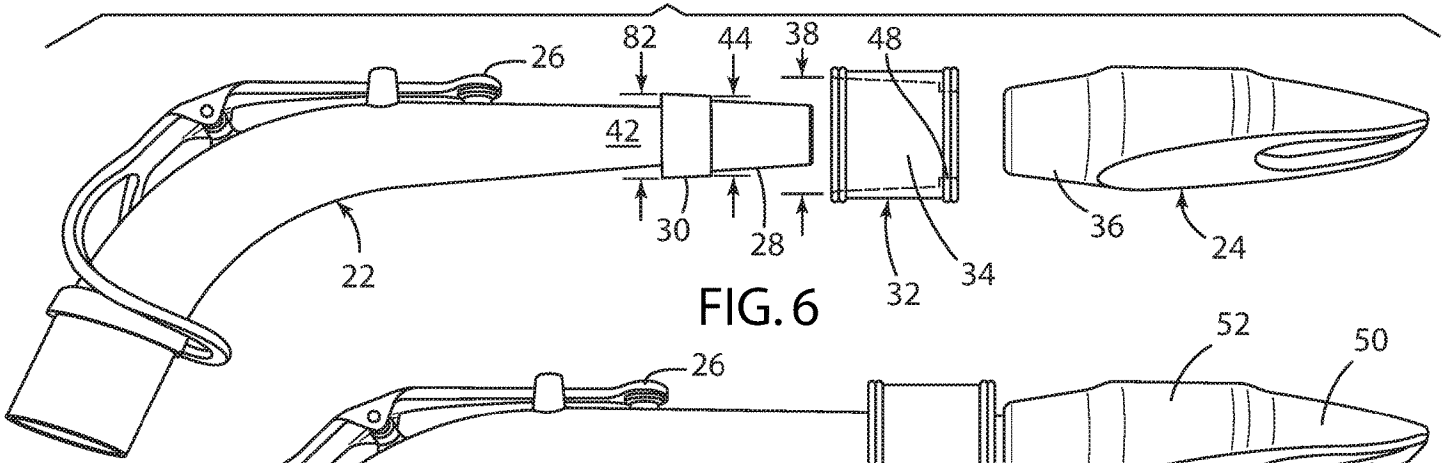
FIG. 5 illustrates an exploded side view of an alternate configuration of the weight accessory of FIG. 1.
Figure 6:
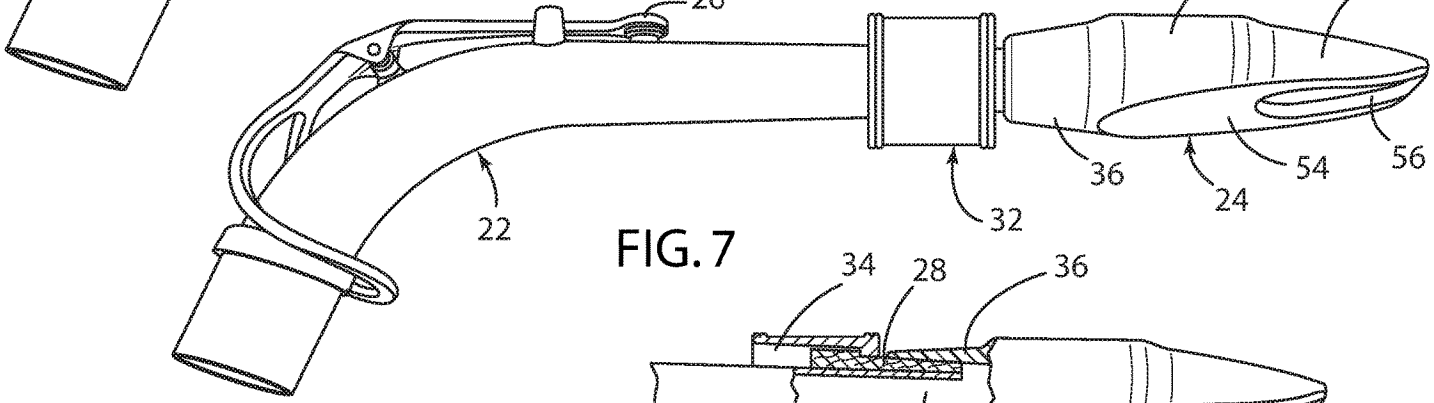
FIG. 6 illustrates a side view of an alternate configuration of an assembled weight accessory of FIG. 5.
Figure 12:
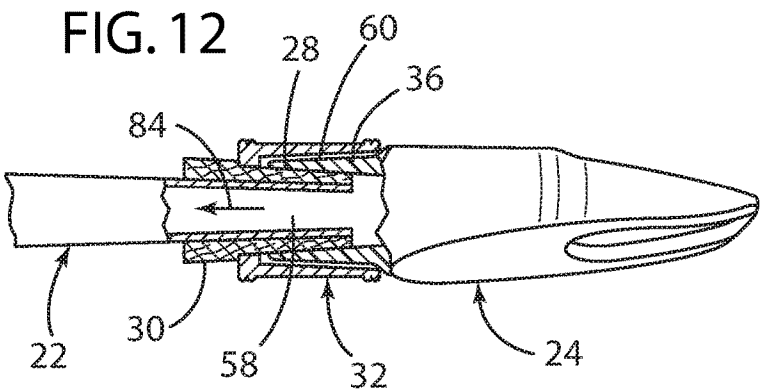
FIG. 12 illustrates a cutaway view of the assembled weight accessory of FIG. 3 according to an alternate approach.
Figure 8:
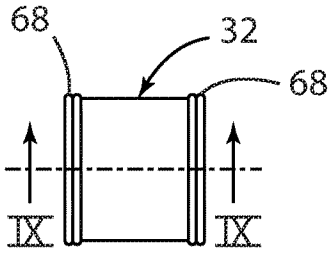
FIG. 8 illustrates a plan view of the weight accessory (32) for a brass instrument neck.
Figure 11:
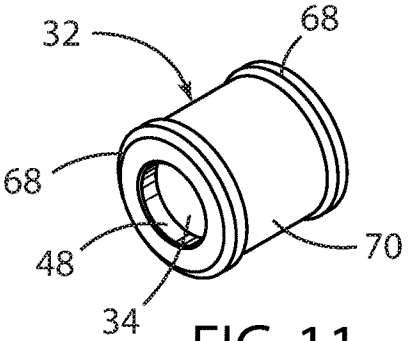
FIG. 11 illustrates a right perspective view of the weight accessory (32) for a brass instrument neck according to one approach.

FIGS. 2-4, 5-7 and 12 show weight 32 exemplary configuration to dampen sympathetic vibrations in exploded (FIGS. 1 and 5), assembled (FIGS. 2 and 6) and cut-away (FIGS. 4, 7 and 12) views of saxophone neck 22 and mouthpiece 24, respectively. Mouthpiece 24, can have a shank 36 having an outer shank dimension 38, a beak 50, a barrel 52, a table 54 (for reed placement), a tip 56, and a bore 58. As shown in FIG. 4, weight 32 is pressed against mouthpiece 24. That is, it is adjacent to and touching mouthpiece 24 by the force of the friction fit. In FIG. 12, there is a gap 60 between weight 32 and mouthpiece 24. This can be achieved either by the reduction of the inner diameter of the weight or the position of weight 32 on neck cork sleeve 28. Gap 60 can be 0.5 mm to 4 mm.

As shown in the figures, neck 22 has a conventional octave key 26, and a neck cork sleeve 28 around its outer surface on its end 42 nearest the mouthpiece. Neck cork sleeve 28 has an outer dimension 44. Neck cork sleeve 28 can have a continuous outer dimension or alternately as shown with neck cork collar portion 30 having an outer dimension 82 that is, for example 0.5 mm to 4 mm, greater than outer diameter 44 to serve as a stop to the installation of mouthpiece 24 and/or weight 32. In other configurations, cork sleeve 28 can be of a continuous or even a decreasing diameter towards the direction of mouthpiece 24 so that the mouthpiece can be pushed onto the cork sleeve up to a point where desired, such as where a snug or airtight fit is accomplished. Weight 32 as shown in this configuration, is configured to be installed on the exposed cork of cork sleeve 28 that would still be exposed after mouthpiece 24 is fitted onto neck 22. Alternately, mouthpiece 24 could be press fitted onto weight 32 rather than press fitted onto sleeve 28. Alternatively, mouthpiece 24 could have and integral weight 32, wherein only the mouthpiece is fitted onto cork sleeve 28.

Figure 7:
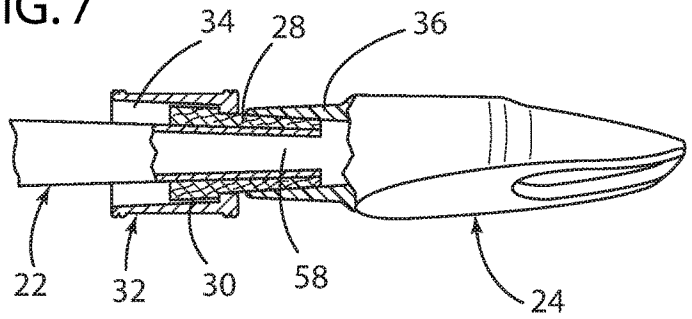
FIG. 7 illustrates a cutaway view of an alternate configuration of the assembled weight accessory of FIG. 6.

As shown in the figures, weight 32 can be inserted onto neck cork sleeve 38 before mouthpiece 24 is fitted onto it. The added mass from weight 32 can be accomplished by extending a portion of weight 32 towards mouthpiece 24, such as shown in FIGS. 4 and 12, or extending it towards neck 22, such as shown in FIG. 7. Weight 32 has a first bore 48 having a diameter 46 configured to allow a press fit onto cork sleeve 28 to dimension 44. Where a collar 30 is present, weight 32 can be pressed up to the collar as shown in FIGS. 3-4 and 6-7. Weight 32 can also have a second bore 34 having an inner diameter dimension 40. Dimension 40 is configured to clear the outer dimension of a shank 36 for the configuration of FIG. 12, or to clear neck 22 for the configuration of FIGS. 5-7, or to allow contact with the outer dimension of shank 36 (FIGS. 2-4).

Figure 9:
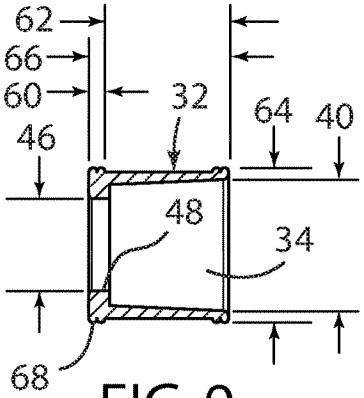
FIG. 9 illustrates a cross section of the weight accessory (32) for a brass instrument neck taken along section lines IX-IX.

FIGS. 8-11 show additional views of weight 32. As shown in FIG. 9, dimension 46 of first bore 48 is sized to allow a press fit to engage cork sleeve 28. Dimension 60 is sized to allow sufficient length of bore 48 grip to cork sleeve 28 (e.g., 2 mm to 10 mm, preferably 4 mm). Weight 32 dimension 62 is sized to allow weight 32 sufficient mass to provide the desired overall weight. The overall diameter 64 of weight 32 is also sized to allow weight 32 sufficient desired mass to provide the desired overall weight, such as 10 mm to 30 mm, preferably around 20 mm).

To accommodate as many types mouthpieces as possible, weight dimension 60 (FIG. 9) would be as small as possible to allow installation of both weight 32 and mouthpiece 24, while still allowance a secure fit of both onto cork sleeve during use of the instrument. Preferably dimension 60 can be between 2 mm and 10 mm, but preferably about 3 mm to 7 mm, and most preferable about 4 mm.

It is noted that specific weights and ranges are provided for illustrative purposes only. Actual weights of individual pieces can vary widely so long as the combined weight of the assembly weigh in use is between 30 grams to 100 grams (and preferably about 50 grams to 70 grams).

Accordingly, weight 32 is sized and proportioned to accommodate a desired weight. First, a desired width 60 (FIG. 9) of bore 48 is selected to adequately grip the cork sleeve 28. Next, determining the inner diameter portion 40 and length dimension 62 so that the overall dimension 66 avoids touching either the neck or the mouthpiece shank when installed, and then expanding the outer diameter 64 until the desired weight is achieved. Dimension 40 can also be angled or contoured to add mass and thus minimize our diameter dimension 64. Although weight 32 is shown as a round column, it is noted that additional shapes of outer surface 70 are also possible, such as an oval, a triangle, a square, a pentagon, and so on. Dimension 64 can also vary from one end to the weight to the other to further optimize the size of the weight.

For exemplary purposes only, in one approach, a 50 gm weight 32 can be made of brass, have a dimension 48 of about 3 mm, a dimension 66 of about 23 mm, a dimension 64 of about 29 mm, a dimension 46 of about 16 mm, a dimension 40 of about 27 mm at its end 72 (FIG. 2), and a dimension 40 of about 22 mm at its end 74 (FIG. 2).

In another approach, a 70 gm weight 32 can be made of brass, have a dimension 48 of about 4 mm, a dimension 66 of about 29 mm, a dimension 64 of about 30 mm, a dimension 46 of about 16 mm (same as above), a dimension 40 of about 28 mm at its end 72 (FIG. 2), and a dimension 40 of about 20 mm at its end 74 (FIG. 2). It is noted that as mentioned above weight 32 is installed on the cork sleeve 28 before (i.e., downwind, see 84, FIG. 4) of mouthpiece 24. Thus, dimension 44 of cork sleeve 28 must be slightly greater at position 78, than dimension 46 of weight 32. For example, cork sleeve 28 dimension 78 can be about 17-18 mm to allow for compression of the cork (or similarly pliable, compressible, and gripable material) when installed by a user. To also allow a similar type of pressure fit of cork 28 to mouthpiece 24, a smaller dimension 44 is needed at position 76. For example, in one approach, cork 28 can have an out dimension 44 at position 78 of about 18 mm, and at position 76 of about 15-16 mm. This allows a mouthpiece 24 with a bore 80 dimension 82 of 15 mm to be pressure fitted onto cork sleeve 28 but not up to the point where it could be adjacent to where weight 82 is seated on the sleeve. It could be expected that an unwanted vibration of weight 32 would occur when the instrument is in use if it was close to being adjacent/touching mouthpiece 24, such as a gap of about 0.5 mm (See gap 60, FIG. 12). As noted though, this would not be an issue in the embodiment of FIG. 4, wherein weight 32 is pressed against shank 36 of mouthpiece 24

Rings 68 can be added to weight 32 to provide a gripping surface to aid in the installation and removal of weight 32 from cork sleeve 28 more, or for aesthetics. Consideration can also be made to produce the weight of the material and/or color of the instrument neck 22. Indicia can also be added to a surface 70 of weight 32.

While the invention herein disclosed has been described by means of specific embodiments, examples and applications thereof, numerous modifications and variations could be made thereto by those skilled in the art without departing from the scope of the invention set forth in the claims.

I claim:

1. A weight for a brass instrument, comprising: an instrument neck directed towards the instrument at a first end and connected to a mouthpiece at a second end; wherein the connection of the mouthpiece to the neck second end is by a friction fit of a cork sleeve having a collar fixed to an outer surface of the neck second end; and a weight connected to the neck second end also by a friction fit from the cork sleeve, wherein sympathetic vibration of a brass instrument is reduced while in use by between 10 and 50 percent.

2. The weight of claim 1, wherein the weight assembly has a weight sufficient to reduce sympathetic vibration of the instrument during use.

3. The weight of claim 2, wherein the weight assembly has a weight in a range of 30 grams to 100 grams.

4. The weight of claim 2, wherein the weight assembly has a weight in a range of 50 grams to 70 grams.

5. The weight of claim 1, wherein a body of the weight is configured to extend from a mount on the cork sleeve towards the mouthpiece.

6. The weight of claim 5, wherein a body of the weight is configured to extend from a mount on the cork sleeve to be adjacent to the mouthpiece.

7. The weight of claim 1, wherein a body of the weight is configured to extend from a mount on the cork sleeve towards the mouthpiece, wherein in an installed position there is a gap between the mouthpiece and the weight.

8. The weight of claim 7, wherein the gap is configured to be between 2 mm and 10 mm.

9. The weight of claim 7, wherein the gap is configured to be between 3 mm to 7 mm.

10. The weight of claim 1, wherein a body of the weight is configured to extend from a mount on the cork sleeve towards the direction of the neck.

11. A brass instrument, comprising: an instrument neck directed towards the instrument at a first end and connected to a mouthpiece at a second end; wherein the connection of the mouthpiece to the neck second end is by a friction fit of a cork sleeve having a collar fixed to an outer surface of the neck second end; and a weight connected to the neck second end also by a friction fit from the cork sleeve, wherein sympathetic vibration of a brass instrument is reduced while in use by between 10 and 50 percent.

12. The brass instrument of claim 11, wherein the weight has a weight sufficient to reduce sympathetic vibration of the instrument during use.

13. The brass instrument of claim 12, wherein the weight has a weight in a range of 30 grams to 100 grams.

14. The brass instrument of claim 12, wherein the weight has a weight in a range of 50 grams to 70 grams.

15. The brass instrument of claim 11, wherein a body of the weight is configured to extend from a mount on the cork sleeve towards the mouthpiece.

16. The brass instrument of claim 15, wherein a body of the weight is configured to extend from a mount on the cork sleeve to be adjacent to the mouthpiece.

17. The brass instrument of claim 11, wherein a body of the weight is configured to extend from a mount on the cork sleeve towards the mouthpiece, wherein in an installed position there is a gap between the mouthpiece and the weight.

18. The brass instrument of claim 11, wherein a body of the weight is configured to extend from a mount on the cork sleeve towards the direction of the neck.

* * * * *